United States Patent [19]

Yamamoto et al.

[11] Patent Number: 4,863,686

[45] Date of Patent: Sep. 5, 1989

[54] HIGH-STRENGTH, EASILY-CASTABLE ZINC ALLOYS

[75] Inventors: Yasunori Yamamoto; Eiji Nishimura, both of Toda, Japan

[73] Assignee: Nippon Mining Co., Ltd., Tokyo, Japan

[21] Appl. No.: 231,798

[22] Filed: Aug. 12, 1988

[30] Foreign Application Priority Data

Aug. 27, 1987 [JP] Japan ..... 62-211288

[51] Int. Cl.[4] ..... C22C 18/04; C22C 30/00

[52] U.S. Cl. ..... 420/516; 420/515; 420/587

[58] Field of Search ..... 420/515, 516, 587

[56] References Cited

U.S. PATENT DOCUMENTS 2,013,870 9/1935 Starmann ..... 420/516
2,589,399 3/1952 Kornblum ..... 420/516
3,671,227 6/1972 Jahnle ..... 420/515
4,609,529 9/1986 Skenazi et al. ..... 420/515

FOREIGN PATENT DOCUMENTS 1551 1/1970 Japan ..... 420/515
28109 9/1970 Japan ..... 420/516

*Primary Examiner*—Robert McDowell
*Attorney, Agent, or Firm*—Seidel, Gonda, Lavorgna & Monaco

[57] ABSTRACT

There is provided a high-strength, easily-castable zinc alloy consisting substantially of, by weight, from 1 to 30 percent aluminum, from 1 to 20 percent copper, from 0.01 to 1 percent titanium, from 0.01 to 1 percent zirconium, and the balance zinc, and also is provided a high-strength, easily-castable zinc alloy further including from 0.01 to 0.1 percent magnesium. These alloys are useful in the manufacture of molds for injection molding of plastics or also useful as die casting products.

10 Claims, 4 Drawing Sheets

HIGH-STRENGTH, EASILY-CASTABLE ZINC ALLOYS

TECHNICAL FIELD

This invention relates to easily-castable zinc alloys of high strength which are suitable to use as molds for injection molding of plastics. The alloys of this invention are also suitable to produce die casting products.

BACKGROUND ART

Molds for injection molding of plastics have hitherto been made of steels, zinc alloys, aluminum alloys, and the like. Steels have sufficient mechanical strengths for molds, and steel molds are now in use for large-quantity production. They, however, have the disadvantages of high cost and long time period required for the mold making. In contrast, the alloys based on zinc or aluminum can be made into molds at lower costs and in shorter periods of time. Especially, zinc alloys typified with Zn-Al-Cu-Mg system are advantageous in that they can be formed into molds by simpler casting methods. However, inadequate mechanical strengths restrict the use of the molds of zinc and aluminum alloys to trial manufacture and small-quantity production.

Medium-quantity production is assuming increasing importance due to the recent trend towards shorter intervals between model changes in automobiles, office automation equipment, and the like. When steel is used for medium-quantity production of their plastic parts, a problem arises in that the mold price forms a considerable proportion of the overall manufacturing cost. Nevertheless, steel has to be employed because the existing zinc and aluminum alloys do not possess the necessary mechanical strengths.

Among steels, zinc alloys, and aluminum alloys, the cheapest to make into molds are zinc alloys, owing to the simplest casting procedure involved. Generally, in the manufacture of a mold by casting, the material is required to exhibit outstanding castability under the conditions that are encountered by large-size and slow cooled castings. This requirement is met by the zinc alloys commercially available today. Thus, if a zinc alloy can attain improved mechanical strength while maintaining its excellent castability, it will serve as the best material for medium-quantity production molds.

It is an object of this invention to have a zinc based alloy having a high strength and good castability which is suitable as a material for molds for injection molding of plastics or as die casting products.

SUMMARY OF THE INVENTION

The present inventors, after extensive studies, have now succeeded in obtaining an alloy which combines high strength with outstanding castability by the addition of given amounts of titanium and zirconium to a Zn-Al-Cu-Mg alloy. Briefly, the invention reside in a high-strength, easily-castable zinc alloy consisting substantially of from 1 to 30 percent aluminum, from 1 to 20 percent copper, from 0.01 to 1 percent titanium, from 0.01 to 1 percent zirconium, and the balance zinc, and also in a high-strength, easily-castable zinc alloy further including from 0.01 to 0.1 percent magnesium.

DETAILED DESCRIPTION

Zinc to be used in the present invention desirably is highest-purity zinc or electrolytic zinc.

Copper for the invention is ordinary electrolytic copper.

As for titanium and zirconium, sponge titanium and sponge zirconium or the like are used, respectively.

Magnesium to be employed is preferably of a purity of 99.99 percent or upwards.

The alloys according to this invention are used in making molds for injection molding of plastics and also used for producing die castings products, especially for the applications where high strength and good castability are essential.

The roles the individual elements play in the composition of the invention will now be explained:

Aluminum is added to increase mechanical strength. If the amount is less than 1 percent its effect is limited, and if the amount exceeds 30 percent, it seriously affects the castability. Hence, the amount of aluminum is confined within the range of from 1 to 30 percent.

Copper too is added for enhanced mechanical strength, and on the same grounds as given above as to Al, the amount is restricted to the range of from 1 to 20 percent.

Titanium and zirconium are both incorporated as agents for refining the cast structure so as to give satisfactory castings. The present invention effects fine primary crystallization uniformly throughout the melt during casting by the combined presence of these excellent refining agents, thereby successfully imparting excellent castability (freedom from pinholing). Titanium has been known to be refining agents, but in the alloy systems of the invention the addition of titanium alone will not produce an adequate refining effect. It is by the combined addition of titanium and zirconium that the exceptional refining effect in the invention is achieved. The beneficial effect of the combined addition has been found for the first time by the present inventors. The addition of titanium and zirconium has limits since less than 0.01 percent each is little effective and more than 1 percent each does not bring a further favorable result. Hence the range of from 0.01 percent to 1 percent each for titanium and zirconium.

Magnesium may not be added, but the addition of from 0.01 to 0.1 percent is helpful in preventing intercrystalline corrosion. The above range is chosen because less than 0.01 percent magnesium is little effective and more than 0.1 percent adds brittleness.

EXAMPLE 1

Highest-purity zinc, electrolytic copper, 99.99%-pure magnesium, sponge titanium, and sponge zirconium were used to made an alloy consisting of 22 percent aluminum, 9 percent copper, 0.03 percent magnesium, 0.05 percent titanium, 0.1 percent zirconium, and the balance zinc.

At a melting temperature of 500° C., the alloy was melted in a graphite crucible.

Figure 1:
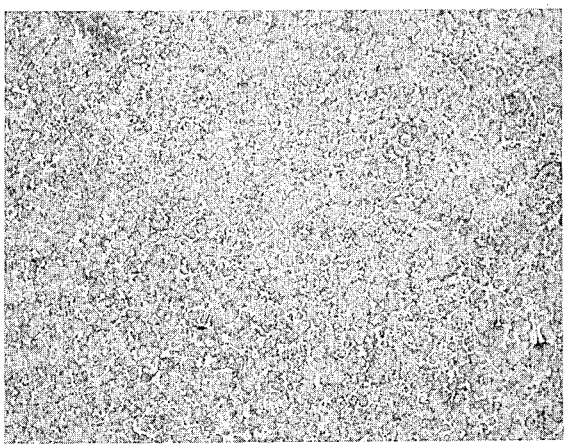
FIG. 1 is a metallographic photograph of alloys according to this invention.

The metallographic structure of the casting thus obtained was examined under a microscope. As shown in FIG. 1, the structure was fine with very few pinholes.

The casting had desirable properties, with a hardness (Hv (10)) of 140, tensile strength (kg/mm$^2$) of 30.0, specific gravity of 5.5, and melting point of 450° C.

EXAMPLE 2

The same conditions as described in the preceding example were used with the exception that 0.03 percent magnesium was not added. The resulting casting exhibited as satisfactory properties, but presented some intercrystalline corrosion problem.

COMPARATIVE EXAMPLE 1

Figure 2:
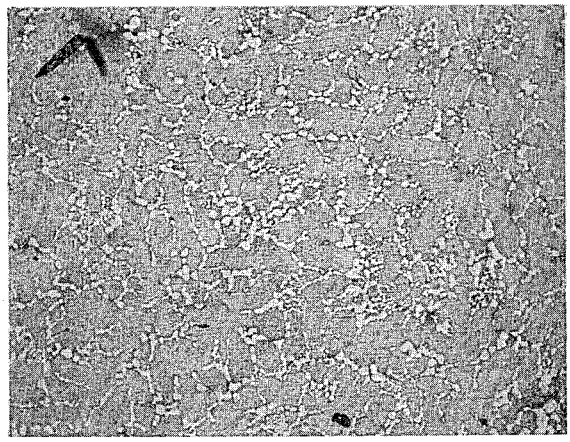
FIGS. 2 to 4 are metallographic photographs of samples prepared in comparative examples.

Compositions given in Table 1, prepared from the same materials as used in the preceding examples, were tested for the properties. Sample No. 1 whose crystal grains were not refined due to the absence of both titanium and zirconium showed undesirable mechanical properties with many pinholes as shown in FIG. 2.

TABLE 1

| | | | | | | (in percent by weight) | | |
|---|---|---|---|---|---|---|---|---|
| No. | Al | Cu | Mg | Ti | Zr | Hardness Hv (10) | Tensile strength (kg/m2) | Specific gravity |
| 1 | 22 | 9 | 0.03 | — | — | 130 | 20 | 6.0 |
| 2 | 22 | 9 | 0.03 | 0.05 | — | 130 | 20 | 5.8 |
| 3 | 22 | 9 | 0.03 | — | 0.1 | 130 | 20 | 6.2 |
| 4 | 4 | 3 | 0.03 | — | — | 110 | 11.4 | 6.7 |

Figure 3:
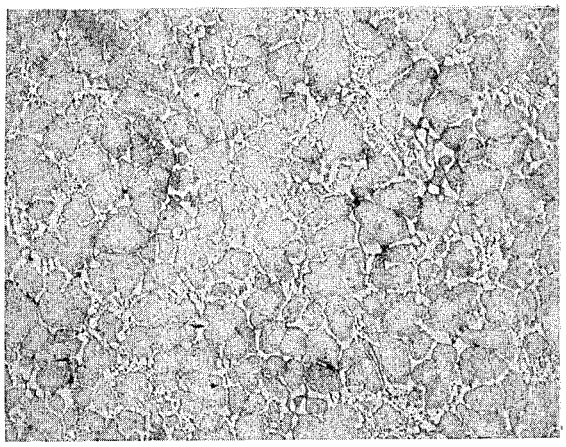
Figure 4:
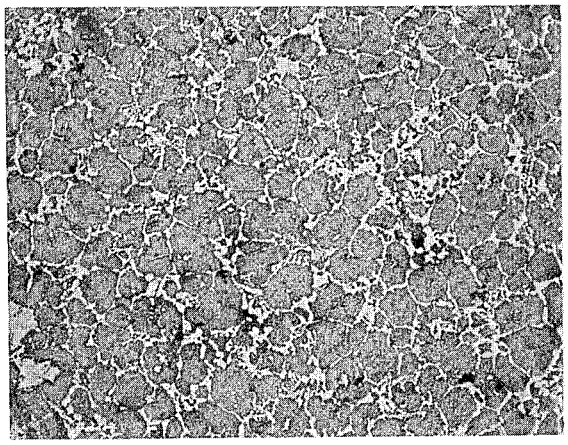

When either titanium or zirconium alone was added as in Sample No. 2 or 3, the crystal grains were not refined and good mechanical properties not attained, as indicated in FIGS. 3 and 4, respectively.

Sample No. 4, representing a conventional composition, was undesirable with very poor mechanical properties.

EXAMPLE 3

According to Example 1, an alloy consisting of, by weight, 22% Al, 15% Cu, 0.03% Mg, 0.1% Ti, 0.1% Zr and the balance Zn was prepared.

The casting had a hardness (Hv (10)) of 170 and tensile strength of 32 kg/mm$^2$.

We claim:

1. A high-strength, easily-castable zinc alloy consisted essentially of, by weight, from 4 to not more than 30 percent aluminum (Al), from greater than 6 to not more than 20 percent copper (Cu), from 0.01 to 1 percent titanium (Ti), from 0.01 to 1 percent zirconium (Zr), and the balance zinc (Zn).

2. A mold for injection molding or die casting made of a zinc alloy according to claim 1.

3. A die casting product of a zinc alloy according to claim 1.

4. A zinc alloy as in claim 1 wherein said weight percent of said aluminum component ranges from about 20 to about 24, wherein said weight percent of said copper component ranges from about 8 to about 17, wherein said weight percent of said titanium component ranges from about 0.04 about 0.11, and wherein said weight percent of said zirconium component ranges from about 0.09 to about 0.11.

5. A mold made from a zinc alloy according to claim 4.

6. A high-strength, easily castable zinc alloy consisting essentially of, by weight, from 4 to not more than 30 percent aluminum (Al), from greater than 6 to not more than 20 percent copper (Cu), from 0.01 to less than 0.1 percent magnesium (Mg), from more than 0.01 to less than 1 percent titanium (Ti), from more than 0.01 to less than 1 percent zirconium (Zr), and the balance zinc (Zn).

7. A mold for injection molding or die casting made of a zinc alloy according to claim 6.

8. A die casting product of a zinc alloy according to claim 6.

9. A zinc alloy as in claim 6 wherein said weight percent of said aluminum component ranges from about 20 to about 24, wherein said weight percent of said copper component ranges from about 8 to about 17, wherein said weight percent of said titanium component ranges from about 0.04 to about 0.11, wherein said weight percent of said zirconium component ranges from about 0.09 to about 0.11, and wherein said weight percent of said magnesium component ranges from about 0.02 to about 0.04.

10. A mold made from a zinc alloy according to claim 9.

* * * * *